US005123395A

United States Patent [19]

Saunders

[11] Patent Number: 5,123,395

[45] Date of Patent: Jun. 23, 1992

[54] ARROW REST SUPPORT SHAFT WITH ENHANCED POSITIONING CAPABILITY

[75] Inventor: Charles A. Saunders, Columbus, Nebr.

[73] Assignee: Saunders Archery Company, Columbus, Nebr.

[21] Appl. No.: 710,463

[22] Filed: Jun. 5, 1991

[51] Int. Cl.[5] ..... F41B 5/22

[52] U.S. Cl. ..... 124/44.5; 124/24.1

[58] Field of Search ..... 124/44.5, 24.1, 41.1, 124/88; 403/290, 362, 261

[56] References Cited

U.S. PATENT DOCUMENTS

| | | | |
|---|---|---|---|
| 3,321,863 | 5/1967 | Maxam, Jr. | 403/290 X |
| 4,095,914 | 6/1978 | Thomsen | 403/290 X |
| 4,299,195 | 11/1981 | Norris | 124/44.5 X |
| 4,686,956 | 8/1987 | Troncoso, Jr. | 124/44.5 |
| 4,715,355 | 12/1987 | Lattig | 124/44.5 |
| 4,809,670 | 3/1989 | Simo | 124/44.5 |
| 4,867,129 | 9/1989 | Scherz | 124/41.1 |

*Primary Examiner*—Peter M. Cuomo
*Attorney, Agent, or Firm*—Michael G. Berkman

[57] ABSTRACT

An arrow rest support shaft or rod with enhanced positioning capability is described. Simple, precise and manually effected positioning of an arrow rest is achieved. A bolt or a threaded stud extending through a predrilled and tapped hole in the bow window is threaded in and locked in place by a bow-abutting lock nut. An elongate shaft projects through and is slideably positionable in an elongate bore extending coaxially through the stud. An arrow rest or a plate for supporting a rest, is attachable to an end of the shiftable shaft. An important feature of the invention comprises an improved and manually-actuable assembly for easily and reliably fixedly securing the slideable arrow-rest-carrying shaft in selectable positions, and immobile with respect to the encircling, bow-mounted stud. One embodiment of the invention utilizes a stud-carried, collet-like end flange or ferrule which may be forcibly compressed radially by a shoulder of a wing nut threaded on the stud, so as stressingly to bear upon the shaft and thus to hold the shaft fixed in the encircling stud. In a second embodiment, an O-ring type element is brought into stressing engagement with the perimetric periphery of the shaft and with an edge of the stud—again to lock the stud and shaft against relative movement. Alternatively, a recessed set screw disposed radially in the stud may be used to hold the shaft fixed with respect to the bored stud.

8 Claims, 2 Drawing Sheets

ARROW REST SUPPORT SHAFT WITH ENHANCED POSITIONING CAPABILITY

BACKGROUND OF THE INVENTION

The present invention relates to an arrow rest, a support rod for an arrow rest, and methods and apparatus for positioning the rest-supporting rod. More particularly, the invention is directed to a simple, precise and manually conducted method and associated apparatus providing an enhanced capability for selectively positioning, locking, releasing, and repositioning and relocking an arrow rest support shaft or rod in place, and, concurrently, to position or to reposition the arrow rest itself.

Many different techniques and mechanisms have been proposed for adjusting the position of an arrow rest on an archery bow. In one class of such devices a plate to which an arrow rest is attachable is fastened by means of a screw which matingly engages within the tapped end of a threaded stud. When it is desired to reposition the plate, or an arrow rest carried thereby, laterally of the bow, using the mechanical arrangement described, it is necessary first to loosen the screw that secures the plate to the threaded stud. Then the threaded stud must be turned to the desired extent, in or out. The stud must next be locked in place and, finally, the screw that holds the plate and/or the arrow rest must be retightened. The procedure described is complicated and time-consuming. Since it may be necessary to repeat the position-adjusting process several times before achieving a desired or sought end result, the method above-described is the more tedious.

It is a principal aim of the present invention to enhance the mode by which an arrow rest support element may be released, repositioned, and, then relocked in place—all easily, simply, precisely and without the use of tools, effectively and quickly to relocate and to reorient the arrow rest itself.

SUMMARY OF THE INVENTION

The present invention provides apparatus and methods by which an arrow rest attached to an archery bow may be rapidly and effectively repositioned and reoriented, as may be necessary in target or hunting use. The apparatus of the invention includes a threaded stud which extends through a cooperating, matingly-threaded bow-mounted boss, or through a threaded lateral bore formed in a window zone of the bow. A nut threaded on the stud is adjustably positionable to effect locking engagement with the bow, against a face thereof.

A feature of the invention is that the threaded stud is formed with a through axial bore through which an arrow rest support shaft or rod is slideably, coaxially received, reciprocally and rotatably therewithin.

The present invention is characterized in that it provides a simple yet highly effective structure by which an arrow rest or a plate element to which an arrow rest is attachable may be repositioned without any need to loosen or to detach the rest or the arrow-rest-supporting element from its locus of attachment.

In accordance with the practice of the present invention positioning and orientation of the arrow rest or an arrow rest support plate or other structure in a desired or elected location and mode are achieved by providing, as the structural support, a shaft or rod which is rotatable and which is reciprocally, slideably, shiftable coaxially within a cooperating through axial bore formed in the bow-supported, threaded bolt or stud.

A related feature of the invention is that there are provided readily actuable and releasable locking mechanisms enabling one quickly and easily to rotate and/or shift the support shaft along a length direction of the threaded stud, to any preferred position. Through the practice of the present invention, the releasing, repositioning, and relocking may be done repeatedly, simply, rapidly and in an effective manner, preferably, without the use of tools.

It is a broad feature of the invention that in locking the shaft against sliding movement within the bore of the threaded stud, resort is had to employing components which cooperate to establish strong frictional forces or mechanical interengagement between the stud and the shaft. These forces are sufficient to prevent relative movement between the two reciprocally-disposed, relatively-rotatable structural components.

It is an important feature of one embodiment of the invention that one preferred structure for locking the shaft in a selectable position includes a shaft-gripping collet, ferrule or collar. An end nut threadedly engaged for travel along the threaded stud carries a radially inwardly directed shoulder or flange. As the nut is threadedly advanced onto the stud at an end thereof, the flange engages an exposed angled edge or end of the shaft-carried collet and urges sections or fingers of the collet to bear down upon the shaft to lock the shaft with the stud and forcibly to prevent relative movement therebetween. Backing off the nut releases the shaft within the bored stud; retightening the nut relocks the assembly.

In a preferred embodiment of the invention the axially-bored and externally threaded stud is integrally formed, at an end thereof remote from the bow window, with a longitudinally slotted collet, band or collar. Radially inwardly directed forces impressed on the collet by advancing a stud-carried nut against an end or angled edge zone of the collet forces the collet sections radially inwardly and firmly against the shiftable shaft of the assembly to effect a position vise-like gripping or clamping of the shaft, precluding relative sliding and rotational movement between the shaft and the threaded stud.

It is a feature of the invention that in one embodiment the slotted collet, against which the stud-carried nut bears, is formed with a taper or with a radially-enlarged end lip or annular edge. The edge includes a bearing surface angled rearwardly and upwardly from an end of the collet. Upon threadedly advancing the stud-carried nut onto the stud, a complimentary shoulder, bevel, or abutment surface formed on the interior of the nut at its lagging end engages the lip of the collet and forces annularly disposed finger elements of the collet into frictionally locking engagement with the arrow-rest-carrying shaft which extends through the threaded stud.

In accordance with the present invention the stud-carried assembly-locking nut is preferably a wing nut, to facilitate manual manipulation.

In a second preferred embodiment of the invention the structure for locking the shaft against movement with respect to the threaded stud includes an O-ring element carried by and encircling the shaft. Advancing an end nut onto the threaded stud brings a nut-carried radial flange, at a rear zone of the nut, laterally against and in abutment with the O-ring to force the ring into ring-compressing contact with the end of the stud and with the perimetric periphery of the stud-encircled shaft. The stud and shaft are thus locked against relative movement. Backing off the nut effects a release of the constrained elements, permitting ready, sleeved sliding as well as rotational repositioning of the arrow-rest-carrying shaft.

A set screw extending radially in the stud, for forcibly engaging the shaft, may also be used as a locking and releasing mechanism for the stud and shaft assembly.

Other and further objects, features and advantages of the invention will be evident from a reading of the following description considered in conjunction with the drawings.

DESCRIPTION OF ILLUSTRATED EMBODIMENTS

Figure 2:
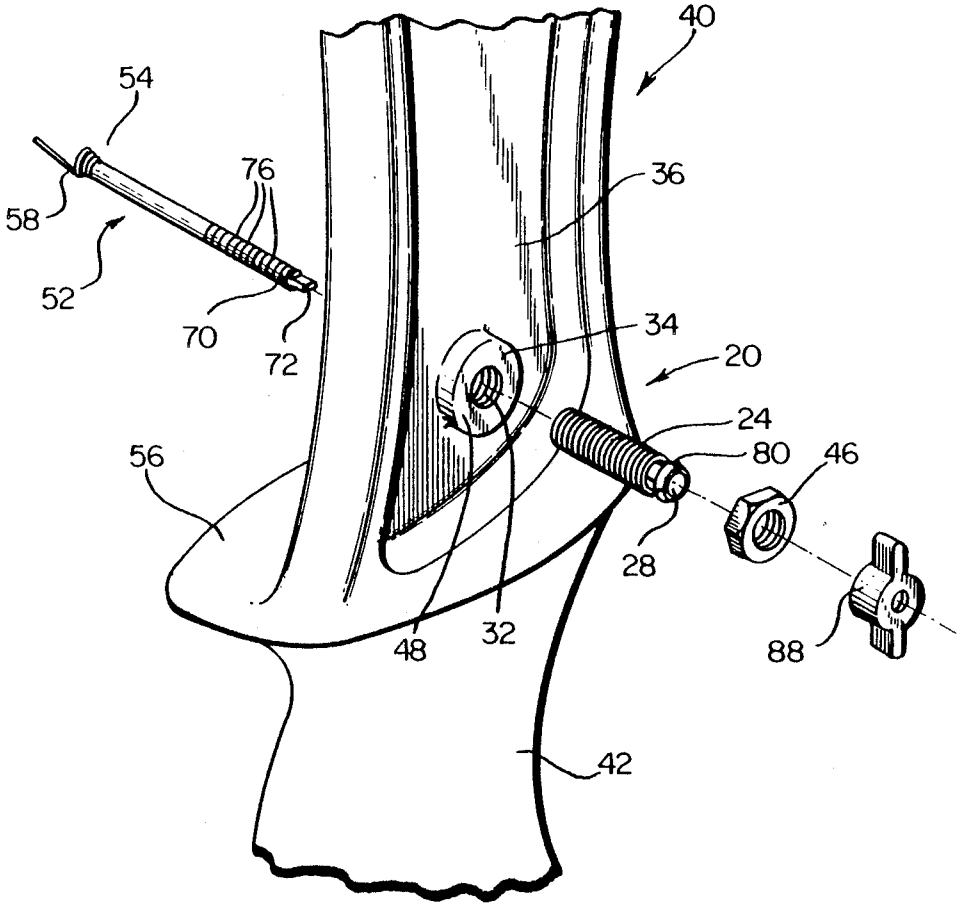
FIG. 2 is an exploded view illustrating schematically the various component elements of the arrow rest support assembly of the invention and their relative dispositions.
Figure 1:
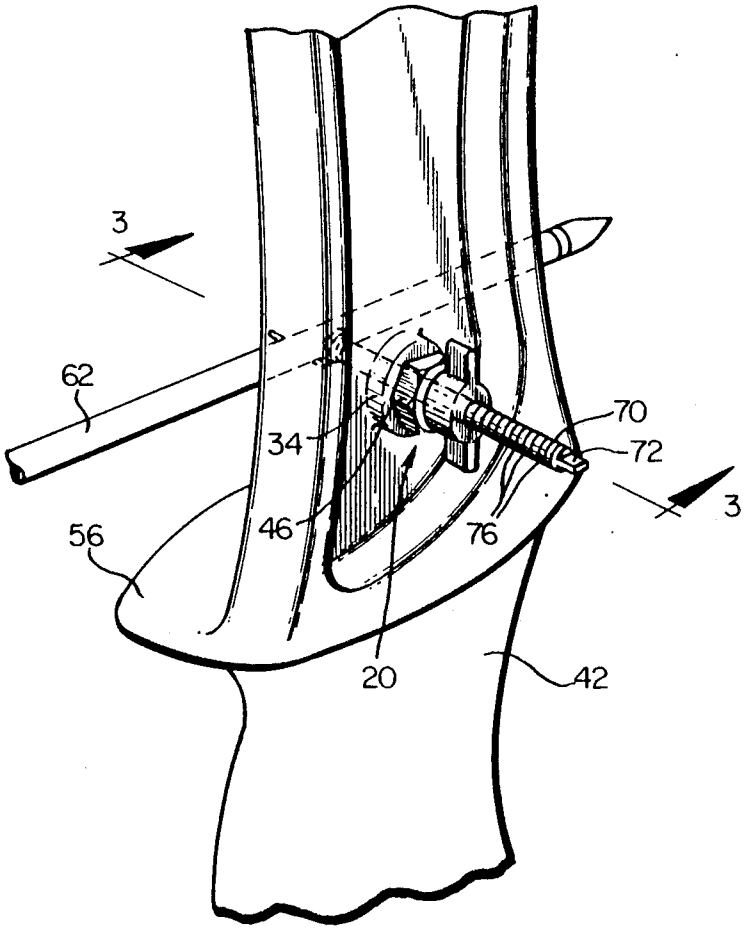
FIG. 1 is a fragmentary perspective view showing an arrow rest support shaft, according to the invention, fastened in arrow-supporting position, in the window zone of an archery bow.

The aims and objects of the invention are accomplished by providing, in an arrow rest support, an improved assembly which includes an arrow rest support shaft with markedly enhanced positioning capability. The structures illustrated and described below each utilizes, in combination, a bow mounted threaded stud which is bored through axially to receive therethrough a shaft for supporting an arrow rest or for supporting a mounting plate to which an arrow rest may be attached. The shaft is slideably and rotatably supported in the encircling, bored stud, and manually manipulable stud-carried elements are readily and easily actuable to lock the adjustably-positionable shaft in place in a selectable longitudinal disposition and in a selectible rotationally attitude, and to release the shaft for repositioning and reorientation.

In accordance with the practice of the present invention a shaft-mounted side plate is more readily and more precisely adjusted in or out to bring the axis of the arrow in line with the path taken by the string as it moves from a drawn to a release position. The structure of the invention facilitates full adjustment for fine tuning of the bow. Readily visible markers incrementally spaced along the arrow rest support shaft ensure controlled and reproducible positioning and adjustment.

Referring now to the drawings, and more particularly to FIGS. 1 through 4, there is shown one preferred embodiment of the arrow rest support assembly of the invention provided for illustrative purposes and not to be construed in any limiting sense.

The arrow rest support assembly 20 illustrated includes a bolt or threaded stud 24 which is formed with a through axial bore 28. The stud 24 is threadedly engaged in a correspondingly-tapped 32 bushing or boss 34 secured in a window zone 36 of a riser section of a bow 40 above the bow handle 42. A lock nut 46 threaded on the stud 24 and tightened against a face 48 of the boss 32 locks the stud 24 in place in the bow 40.

An elongate rod or shaft 52 sized for sliding, reciprocally, within the tubular bore 28 in the stud 24 is positioned within and projects beyond each end of the stud 24. At its end 54 which overlies the shelf 56 of the bow 40 the shaft 52 is adapted to support an arrow rest 58, or a mounting plate to which an arrow rest may in turn be fastened, for supporting an arrow shaft 62 thereon. In the illustrated structure, the end 54 of the shaft 52 is drilled axially and tapped to accept a screw 64 for holding the rest 58 or a rest-supporting plate. At its opposite end 70 the shaft 52 terminates in a flattened sector 72 to facilitate gripping and manipulation.

A substantial lineal expanse of the shaft adjacent the grip end sector 72 is provided with an array of visual reference indicia or lineally-spaced scale elements 76 or demarkations constituting reference markers to facilitate effecting meaningful adjustments in longitudinally shifting and resetting of the arrow rest supporting shaft 52 in the stud 24.

Figure 3:
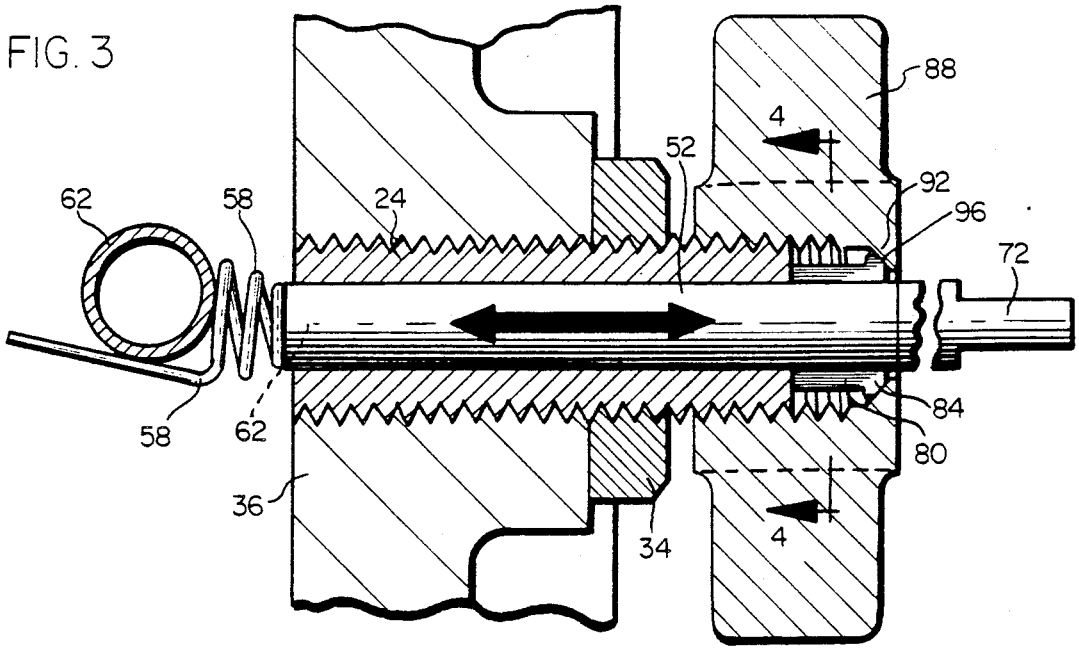
FIG. 3 is an enlarged, cross sectional view taken substantially on the lines 3—3 of FIG. 1 and showing a wing nut advanced on the threaded stud and urging a collet, collar, or ferrule-like band into gripping engagement with to lock the arrow rest support shaft fixedly within the bored mounting stud.
Figure 4:
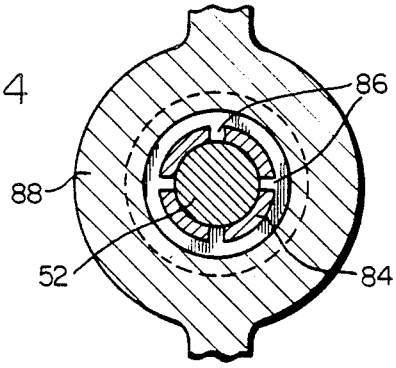
FIG. 4 is a cross sectional view taken substantially on the lines 4—4 of FIG. 3 and showing the slotted or sectioned ferrule in gripping engagement with the arrow rest support shaft.

Referring now to FIGS. 2, 3 and 4, and more particularly to FIGS. 3 and 4, the end of the threaded and bored stud 24 not secured in the bow-mounted boss 34 is formed with a ferrule-type, collet-like band or collar 80 terminating in a tapered or angled end flange or compression ring 84. In the particular embodiment of the invention illustrated, the band or collar 80 is an integrally formed terminal section of the stud 24 itself. Longitudinally extending cut-out slots 86 in the collar 80, open endwise, divide the collar 80 into a plurality of flexible arcuate sectors. These sectors are amenable to forces displacement radially inwardly so as stressingly to bear upon and grippingly to engage the shaft 52 extending therethrough.

As shown in FIG. 3, a wing nut 88 threaded for mating engagement with the threaded stud 24 is formed, at its lagging end, with a radially inwardly directed annular shoulder 92. The shoulder 92 includes a bearing surface 96 for abutment against the pressure-deformable end ring 84 of the shaft-engaging band-like collar 80. As the digitally manipulable wing nut 88 is threadedly advanced onto the stud 24, the integrally formed shoulder 92 engages and bears against the compressible, deformable sectional ring 84 of the collar 80 of the shaft 52 to lock the shaft against movement with respect to the stud 24. A backing-off of the wing nut 88 effects a release of the shaft 52 to permit longitudinal as well as rotational repositioning of the arrow rest support shaft 52. As previously indicated, annular markings 76 arrayed lineally on the shaft 52 constitute reference indicia facilitating precise and reproducible adjustments in positioning the shaft 52 longitudinally.

Figure 5:
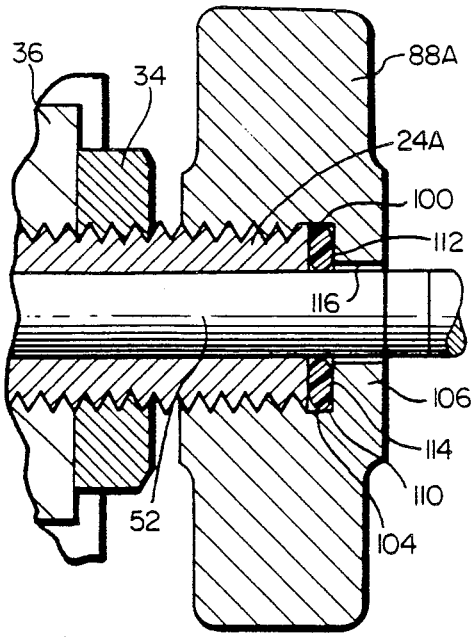
FIG. 5 illustrates a second embodiment of the invention, in which an O-ring type element is urged by a wing nut into compressing engagement with the threaded, bored stud and the shaft extending therethrough, to look the stud and shaft against relative movement.

In a second embodiment of the invention, depicted in FIG. 5, different mechanical structures are invoked to lock the arrow rest support shaft 52 fixed within the stud 24A. An O-ring type element 100 is sleeved onto the shaft 52 to abut a flat end face 104 of the stud 24A. The wing nut 88A is formed with a radially inwardly directed flange 106 extending from and communicating with an annular wall 110. An inner face 114 of the flange 106 is bounded by a radial wall 112, and a cylindrical wall 116 of the flange 106 encircles the shaft 52. As indicated schematically in FIG. 5, threadedly advancing the wing nut 88A onto the stud 24A effects a compression of the O-ring, confined in a cavity bounded by the stud end 104, the shaft 52 and the walls 110 and 112 of the wing nut 88A, to lock the shaft 52 with the stud 24A. Again, backing off the wing nut 88A releases the shaft 52.

Figure 6:
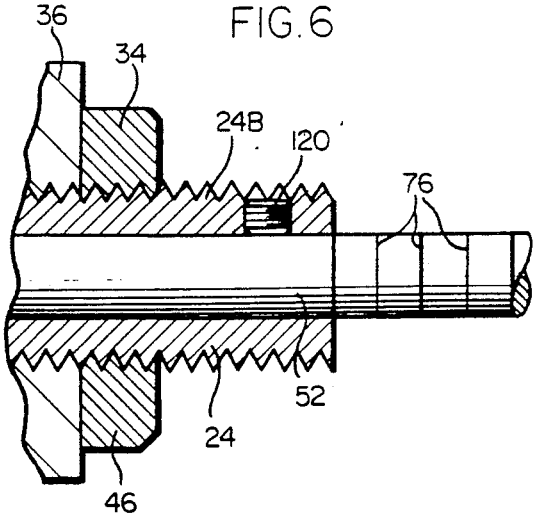
FIG. 6 shows a third embodiment of the invention, in which a set screw or locking screw is threaded radially in the wall of the stud for engaging a periphery of the arrow rest support shaft to lock the shaft against movement relative to the stud.

In the embodiment of the invention shown in FIG. 6, the shaft 52 is locked in place within and with respect to the stud 24B by means of a set screw 120 threaded radially into the stud 24B. Conveniently, the set screw is formed with a key-receiving, non-circular socket for acceptance of a hex-wrench such as an Allen key or the like.

While several embodiments of the invention have been illustrated and described, these are not to be construed as in any way limiting the invention In the light of the present disclosure, other structures for realizing the objects and goals of the present invention will occur to those skilled in the art. Such modifications, which will be evident without invoking the invention faculty, are deemed to be within the spirit and scope of the appended claims. For example, a ferrule, a collet or a locking ring separate and distinct from the stud and from the arrow rest support shaft may be rised as a wedging element in conjunction with a nut, or a wing nut, releasably to lock the stud and shaft to one another.

What is claimed is:

1. Apparatus for adjustably supporting and positioning an arrow rest on an archery bow, said apparatus comprising a threaded stud adapted to extend through a cooperating lateral bore formed in a window zone of an archery bow, means shiftable longitudinally along said threaded stud selectively to lock and to release said stud at a window zone of a bow through which said threaded stud extends, said threaded stud being formed with a longitudinal bore extending lineally, coaxially through said threaded stud, an elongate shaft being rotatably and reciprocally sleeved in and freely slidable within and through said longitudinal bore of said stud longitudinally along a lineal expanse of said stud for supporting an arrow rest support element, said shaft having one end adapted for securing said arrow rest support element thereto, locking means for engaging said threaded stud and said shaft for establishing stressing forces therebetween to lock said shaft in said stud and to prevent relative longitudinal displacement and relative rotation therebetween, said means for establishing stressing forces between said threaded stud and said shaft sleeved therewithin comprising radially deformable collet means, said collet means encircling and embracing said shaft exteriorly thereof, and drive means for urging said locking means to establish frictional forces between said stud and said shaft to deter relative sliding movement therebetween and to lock said shaft and said arrow rest support element carried thereby in a selectable, fixed extended position and rotational attitude, said drive means including an end nut means for threaded travel along said stud, and further comprising flange means carried by said end nut means and shiftable lineally along to advance on said stud as said end nut means is threadedly turned on said stud, said flange means extending radially inward of a periphery of said stud and in radial proximity to said shaft and defining an abutment shoulder for bearing against an exposed end zone of said collet means forcibly to urge said collet means against said shaft as a shaft-gripping element to prevent relative movement between said stud and said shaft.

2. The structure as set forth in claim 1 characterized in that said shaft is slideably shiftable within and displaceable in selective longitudinal increments for facilitating and for effecting fine adjustments in positioning an exposed end of said shaft longitudinally of said threaded stud and laterally of the bow in a window zone thereof.

3. The structure as set forth in claim 1 and further comprising visual reference indicia on said shaft as scale elements, said scale elements comprising lineally spaced marker means extending along said shaft and spatially stepped for facilitating meaningful incremental sliding adjustments in the positioning of said shaft within said stud.

4. Apparatus for adjustably supporting and positioning an arrow rest on an archery bow, said apparatus comprising a threaded stud adapted to extend through a cooperating lateral bore formed in a window zone of an archery bow, means shiftable longitudinally along said threaded stud selectively to lock and to release said stud at a window zone of a bow through which said threaded stud extends, said threaded stud being formed with a longitudinal bore extending lineally, coaxially through said threaded stud, an elongate shaft being rotatably and reciprocally sleeved in and freely slidable within and through said longitudinal bore of said stud longitudinally along a lineal expanse of said stud for supporting an arrow rest support element, said shaft having one end adapted for securing said arrow rest support element thereto, locking means for engaging said threaded stud and said shaft for establishing stressing forces therebetween to lock said shaft in said stud and to prevent relative longitudinal displacement and relative rotation therebetween, said locking means comprises O-ring means disposed to contact said stud and said shaft, and nut means to effect compression of said O-ring means between an end of said stud and said shaft for preventing sliding relative movement therebetween, said nut means including an end nut for threadedly engaging said stud at an end zone thereof remote from an arrow rest end of said stud, wherein said O-ring means encircles said shaft in a zone adjacent said end nut, and further comprising O-ring-engaging flange means carried by said end nut, said flange means encircling and projecting radially toward said shaft for abutting laterally against said O-ring means as said end nut is threadedly advanced onto said stud, and for compressingly and stressingly urging said O-ring means into compressed, stressing engagement with an end edge zone of said stud and with said shaft to lock said shaft against reciprocal sliding longitudinal movement relative to said stud.

5. Apparatus for adjustably supporting and positioning an arrow rest on an archery bow, said apparatus comprising a threaded stud adapted to extend through a cooperating lateral bore formed in a window zone of an archery bow, means shiftable longitudinally along said threaded stud selectively to lock and to release said stud at a window zone of a bow through which said threaded stud extends, said threaded stud being formed with a longitudinal bore extending lineally, coaxially through said threaded stud, an elongate shaft being rotatable and reciprocally sleeved in and freely slidable within and through said longitudinal bore of said stud longitudinally along a lineal expanse of said stud for supporting an arrow rest support element, said shaft having one end adapted for securing said arrow rest support element thereto, locking means for engaging said threaded stud and said shaft for establishing stressing forces therebetween to lock said shaft in said stud and to prevent relative longitudinal displacement and relative rotation therebetween, said locking means including nut means threadedly engaged on said stud and manipulable for alternately locking said shaft and freeing said shaft for sliding and rotating orientation within said stud, said nut means including an interiorly threaded core for mating engagement with external threads of said threaded stud for lineal travel therealong, and further compressing sleeve means at an end of said stud for gripping said shaft, said core of said nut means being integrally formed with radially inwardly directed flange means defining a restricted opening of a diameter less than a diameter of said stud but large enough to allow free passage and travel of said shaft therethrough, said flange means including shoulder means for stressingly abutting said sleeve means to urge said sleeve means into stressing engagement with said shaft positively to embrace an annular periphery of said shaft to prevent relative movement between said stud and said shaft.

6. The structure as set forth in claim 5 wherein said sleeve means is integrally formed with said stud at an end zone thereof, said sleeve means defining a generally cylindrical wall of a reduced radial thickness as compared with said stud and being formed with longitudinally extending slot means opening endwise for sectioning said sleeve means to facilitate compression of said sleeve means to bear upon and restrain said shaft within said stud.

7. The structure as set forth in claim 6 wherein said slot means constitutes a plurality of slots to establish a plurality of arcuate sleeving elements carried by said stud and encircling said shaft in radial proximity thereto.

8. The structure as set forth in claim 7 wherein said sleeve means is formed with annular lip means at a free end zone thereof for stressingly engaging the stud-carried by said nut means upon advance of said nut means onto said stud to effect displacement of said sleeving elements radially inwardly and into stressing abutment with said shaft to establish compression forces for firmly securing said shaft within said stud.

* * * * *